US005195598A

United States Patent [19]

DeVall

[11] Patent Number: 5,195,598

[45] Date of Patent: Mar. 23, 1993

[54] DRILL HEAD ASSEMBLY

[76] Inventor: Donald L. DeVall, 1082 Charles Ave., Morgantown, W. Va. 26505

[21] Appl. No.: 814,399

[22] Filed: Dec. 23, 1991

[51] Int. Cl.[5] ..... E21C 7/02

[52] U.S. Cl. ..... 173/197; 173/DIG. 3; 279/15

[58] Field of Search ..... 173/197, 74, 79, DIG. 3; 279/156

[56] References Cited

U.S. PATENT DOCUMENTS

| | | | |
|---|---|---|---|
| 3,766,991 | 10/1973 | Brown | 173/197 |
| 3,779,040 | 12/1973 | Garrett | 173/197 |
| 3,800,887 | 4/1974 | West | 173/197 |
| 3,901,330 | 8/1975 | Slator et al. | 173/197 |
| 4,190,116 | 2/1980 | O'Neal et al. | 173/DIG. 3 |
| 4,416,337 | 11/1983 | Phillips et al. | 173/57 |
| 4,487,271 | 12/1984 | Pomeroy et al. | 173/197 |

*Primary Examiner*—Frank T. Yost
*Assistant Examiner*—Scott A. Smith
*Attorney, Agent, or Firm*—Webb, Burden, Ziesenheim & Webb

[57] ABSTRACT

An improved rotary drill head assembly including a drill head cover having an upper portion, a rotatable drill retaining socket having an outer surface and a support member having an upper portion. The socket extends above the support member. A flinger attached to the upper portion of the support member and having an axial passage extending therethrough, a top cap having an axial passage extending therethrough. An arrangement for attaching the flinger to the top cap including a pin received by one of the flinger and the top cap. A top plate attached to the top cap. The top plate includes an arrangement to protect the pin from the outside environment and to hold the pin in place against axial movement. A sealing arrangement between the upper portion of the drill head cover and the flinger. The flinger, top cap, top plate and upper portion of the drill head cover may be coated with a ceramic material.

20 Claims, 3 Drawing Sheets

DRILL HEAD ASSEMBLY

FIELD OF THE INVENTION

This invention relates to an improved rotary drill, and more particularly to a flinger arrangement of the drill head assembly for a rotary drill.

DESCRIPTION OF THE PRIOR ART

In rock drilling operations, it is a known practice to drill holes in a rock formation by a rotary drill assembly or by a rotary percussion drill assembly. These assemblies include a drill pot that carries a hydraulic motor having a motor shaft rotatably connected to a bevel gear which meshes with another bevel gear rotatably journaled on a support member or hub within the drill housing. It is affixed to a rotatable head or cover, which has a seat into which the shank of a drill steel is received. A drill bit is positioned on the upper end of the drill steel. With this arrangement, rotation of the motor shaft is transmitted to the drill steel to rotate the drill bit.

Generally, the drill assembly is carried by a self-propelled machine that maneuvers the drill pot into position and moves the drill pot in the direction of advancement of the drill bit into the rock formation. For rock drilling operations in an underground mine, the drill assembly is supported by a boom that is pivotally mounted on the front of a mobile frame. Upward movement of the boom moves a drill steel seated in the pot cover into drilling position. As the drill steel rotates, the boom exerts upward pressure on the drill assembly to increase the driving thrust on the drill steel. This advances the drill steel vertically into the rock formation as rock materials dislodge from an elongate bore drilled in the rock formation. The upward force exerted upon the drill assembly by the boom overcomes resistance of the rock structure to rotation of the drill bit. An example of such a drilling machine is disclosed in U.S. Pat. No. 3,190,369.

Dust is a problem causing deterioration of the gearing and bearings of drill assemblies. Therefore, extensive seal arrangements are provided on the drill head assemblies, such as disclosed in U.S. Pat. No. 4,416,337, which is hereby incorporated by reference.

The drill head assembly disclosed in U.S. Pat. No. 4,416,337 is set forth in FIG. 1, and includes a rotary drill 2 having a hydraulic rotary motor 3, a drill head 4 and a drill steel 5. The bevel gear arrangements, bearings and internal seals are contained within a drill housing 6 having a drill case 7 and a drill cover 8. The seal between the outside environment and the drill steel 5 is accomplished through a flinger assembly which includes a flinger 9 and a top cap 10 that is attached to the flinger 9 by screws 11.

The structure disclosed in U.S. Pat. No. 4,416,337 overcomes many of the sealing problems in the prior art. However, the flinger assembly still encounters problems due to the corrosive environment present in the mines. Typically, the screws connecting the top cap 10 to the flinger 9 corrode, making it very difficult to remove the top cap from the flinger. Further, coal dust and other particles become embedded within the screw threads of screws 11, making it extremely difficult to reconnect the top cap 10 to the flinger 9. Furthermore, the flinger 9 includes a labyrinth seal that is difficult and expensive to manufacture.

It is an object of my invention to provide a rotary drill head having a flinger assembly with a top cap and a flinger that can be easily removed from the drill head assembly.

It is a further object of my invention to provide a rotary drill head having a flinger assembly that is less expensive than prior art rotary drill heads.

BRIEF DESCRIPTION OF THE DRAWINGS

FIG. 7 is a top view of the top plate shown in FIG. 4;

FIG. 10 is a bottom view of the top plate shown in FIG. 4;

FIG. 12 is a bottom view of the flinger shown in FIG. 6;

SUMMARY OF THE INVENTION

The invention is an improved rotary drill head assembly including a drill head cover having an upper portion, a rotatable drill retaining socket having an outer surface and a support member having an upper portion, the socket extends above the support member. The improvement is a flinger attached to an upper portion of the support member and having a passage passing therethrough, a top cap having a passage passing therethrough and an arrangement for attaching the flinger to the top cap having a pin as received by at least one of the flinger or the top cap. The flinger passage and the top cap passage form a flinger assembly passage through which the socket passes. The arrangement for attaching the flinger to the top cap can include a pin-receiving recess defined by an outer surface of the flinger and a pin-receiving slot passing axially through the top cap wherein the pin passes through the slot and is received within the recess.

The improved drill head assembly includes a first seal positioned between the top cap and the flinger and a second seal positioned between the top cap and the socket. The first seal and the second seal can include O-rings.

The improved drill head assembly further includes a top plate having a passage passing therethrough, which is defined by an inner surface, and attached to the top cap. The top plate is removably attached to the top cap whereby the inner surface covers an end of the top cap pin-receiving slot. An O-ring can be sandwiched between the inner surface of the top plate and the top cap so that the top plate is frictionally held in place.

The top plate, top cap or the flinger can have a ceramic coating formed thereon.

The improved rotary drill head assembly also includes an upper portion of the head cover having a first surface, a second surface and a third surface. The first and the second surfaces are concentric and cylindrically shaped. The third surface connects to the first surface and the second surface and is in the shape of a flat annulus. Likewise, the flinger includes an annular recess opening from the bottom surface. The recess is defined by first, second and third walls. The first and second walls are concentric and cylindrically shaped and the third wall is connected to the first wall and the second wall and is in the shape of a flat annulus. The first surface and the third surface are positioned adjacent to and in close proximity to the first wall and the third wall, respectively, thereby forming a liquid tight seal therebetween and sealing an internal cavity of the drill head assembly from the outside environment.

An additional fluid seal can be positioned between the second surface and the second wall. The above-described walls and surfaces can be coated with a ceramic material.

DESCRIPTION OF THE PREFERRED EMBODIMENTS

Figure 1:
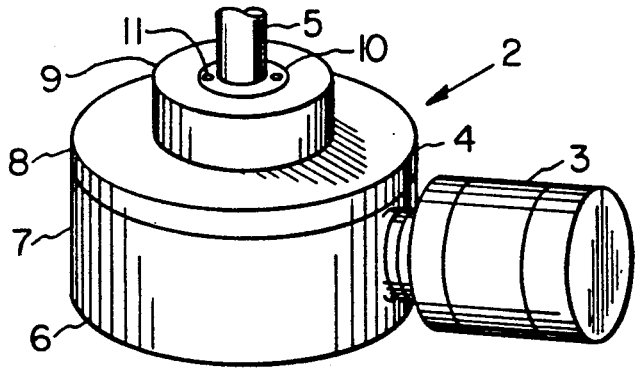
Fig. 1 PRIOR ART
FIG. 1 is a perspective view of a rotary drill head of the prior art.
Figure 2:
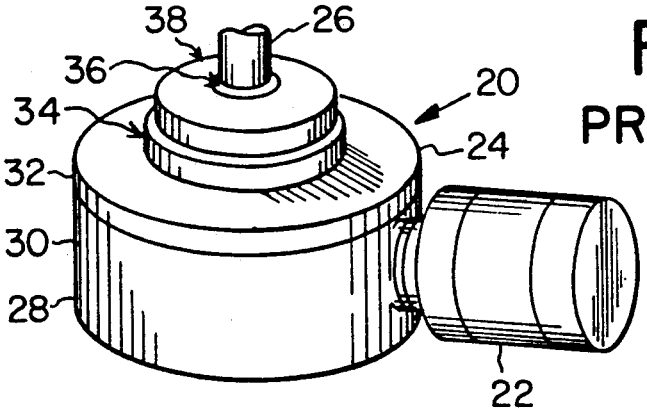
FIG. 2 is a perspective view of a rotary drill head in accordance with the present invention.

FIG. 2 of the drawings shows a rotary drill assembly generally designated 20. The drill assembly includes a hydraulic motor 22, a drill head 24 and drill steel 26 driven by the gear arrangement contained within the drill head. Drill head 24 further includes a drill housing 28, which contains the drive gear arrangement. Drill housing 28 includes a drill case 30 and a drill head cover 32 which screws onto drill case 30. A flinger 34 is positioned above drill head cover 32 and is attached thereto. A top cap 36 is attached to flinger 34 and a top plate 38 is positioned over top cap 36 and is removably attached thereto. Flinger 34, top cap 36 and top plate 38 form a flinger assembly 40.

As shown in FIGS. 3, 6, 9, 12 and 13 of the drawings, the flinger 34 has an axial passage 44 passing therethrough and includes an annular first cylindrical section 50 and an annular integral second cylindrical section 52. First cylindrical section 50 includes a threaded surface 54 on the passage 44 and a bottom surface 56. A downwardly opening annular recess 58 is formed in first cylindrical section 50 and is defined by walls **58*a*, 58*b* and 58*c*. Spaced walls 58*a* and 58*c* are concentric and cylindrical and annular wall 58*b* connects walls 58*a* and 58*c***.

Second cylindrical section 52 includes an annular surface that defines a pin receiving recess 60. Recess 60 is located between a first plate 62 and a second plate 64. Second cylindrical section 52 also includes an inner surface that defines a portion of passage 44.

As shown in FIGS. 3, 5, 8, 11 and 13 of the drawings, top cap 36 is substantially cylindrical and includes an annular upper section 70, an annular bottom section 72 and an inner surface 74, which defines a passage 75 passing through the top cap. Upper section 70 has a cylindrical outer surface 76 and a plurality of cylindrical pin-receiving slots 78. Annular recess 79 is formed in upper section 70. Recess 79 has a U-shaped cross section and is coaxial with upper section 70. Pin-receiving slots 76 intersect recess 79. Spaced O-ring grooves 80, 82 are formed in inner surface 74 in upper section 70. An O-ring groove 84 is defined on the outer surface of bottom section 72. A circular lip 86 is located below O-ring groove 84 along the outer surface of bottom section 72.

As shown in FIGS. 3, 4, 7, 10 and 13 of the drawings, top plate 38 is generally cylindrical and includes an upper surface 100, a bottom surface 102, an outer side surface 103 and an inner surface 104. A passage 105 extends through top plate 38 and an O-ring groove 106 is formed in inner surface 104. A coaxial annular lip 108 having a top surface 100 extends inwardly from the upper portion of top plate 38.

Figure 13:
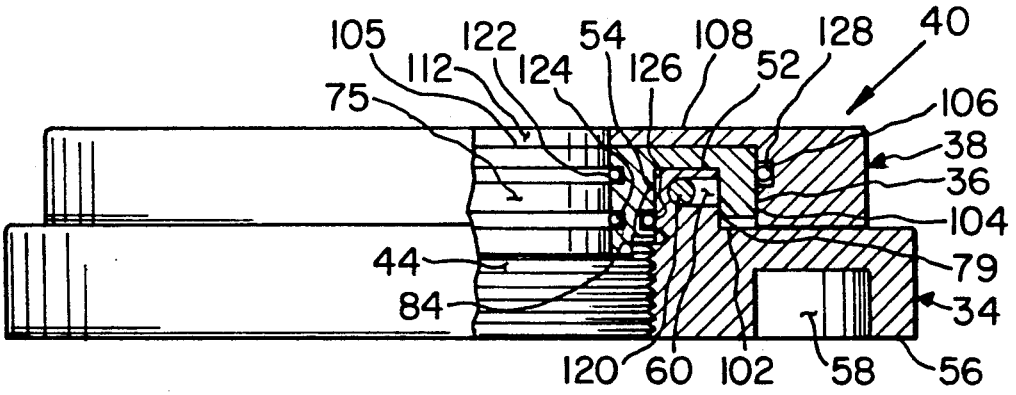
FIG. 13 is a side view partially in section of the flinger assembly shown in FIG. 3.

Assembly of the flinger assembly is set forth hereinafter. As shown in FIG. 13 of the drawings, flinger second section 52 is slidably received by top cap 36 within recess 79. Top cap 36 is slidably received by top plate 38 within passage 105 and is positioned adjacent to top plate O-ring groove 106. Top cap outer surface 76 abuts a portion of top plate lip 108, and top cap outer surface 76 abuts a portion of top plate inner surface 104. Flinger pin-receiving recess 60 is contained within top cap recess 79. Top plate bottom surface 102 abuts an upper surface of flinger 34. Flinger passage 44, top cap passage 75 and top plate passage 105 define a coaxial flinger assembly passage 112.

Figure 14:
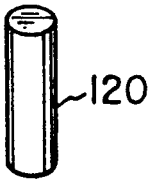
FIG. 14 is a perspective view of a pin in accordance with the present invention.
Figure 8:
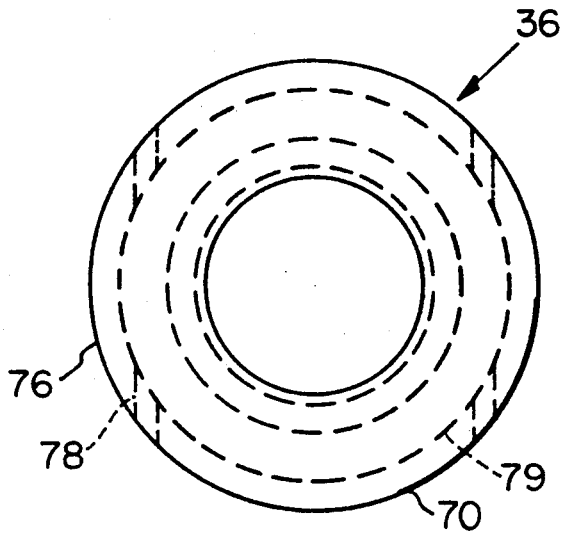
FIG. 8 is a top view of the top cap shown in FIG. 5.
Figure 11:
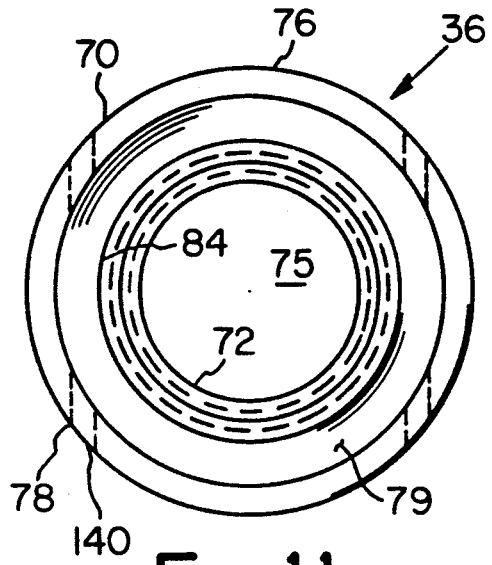
FIG. 11 is a bottom view of the top cap shown in FIG. 5.
Figure 9:
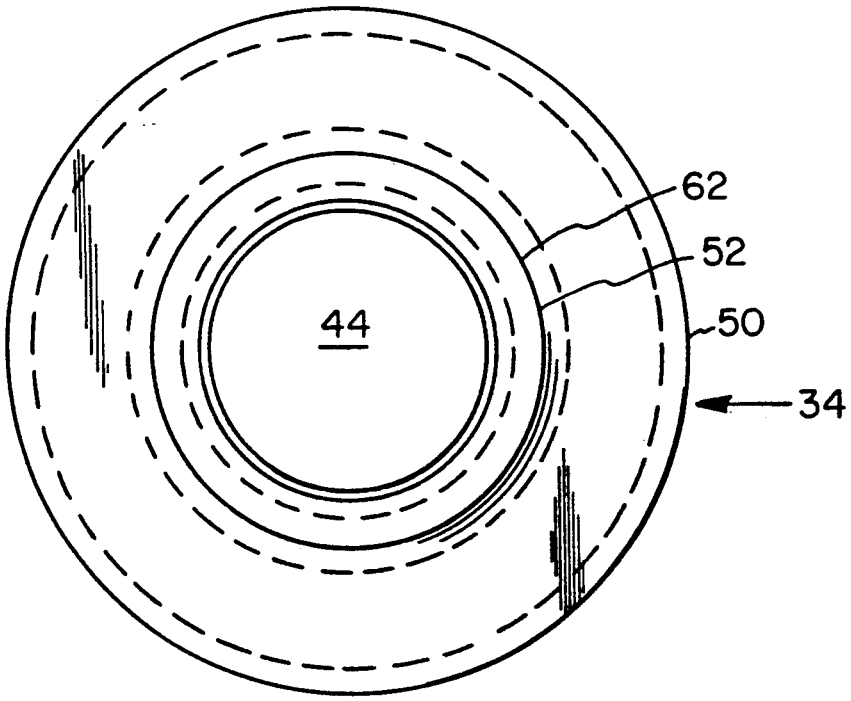
FIG. 9 is a top view of the flinger shown in FIG. 6.

A plurality of cylindrical retaining pins 120, shown in FIG. 14 of the drawings, pass through pin receiving slots 78 in top cap 36 and are removably received within the pin receiving recess 60 of flinger 34. Accordingly, top cap 36 is held in place on flinger 34 by pins 120.

Flinger 34 need not be limited to recess 60 to accommodate pins 120, and may be modified in any manner, such as with separate holes, to accommodate pins 120. Likewise, top cap 36 need not be limited to slots 78 to accommodate pins 120, and may be modified in any manner, such as a recess, to accommodate pins 120. O-rings 122, 124 and 126 are received within top cap O-ring grooves 80, 82 and 84, respectively O-ring 126 is sandwiched between an upper portion of flinger inner surface 54 and top cap O-ring recess 84 forming a fluid tight seal therebetween.

Top plate O-ring groove 106 receives an O-ring 128, which is sandwiched between top cap cylindrical outer surface 76 and top plate O-ring groove 106 so that top plate 38 is frictionally held in place by the O-ring. This permits top plate 38 to be removably attached to the cylindrical outer surface 76 of the top cap. Top plate inner surface 104 covers an end 140 of top cap pin-receiving slot 78, thereby protecting pins 120 from damage and retaining pins 120 in place.

As shown in FIG. 14 of the drawings, "Flinger 34, top" cap 36 and top plate 38 are made of metal and may be coated with a ceramic coating, such as $SiO_2$ or $Al_2O_3$. The ceramic coating provides excellent wear characteristics, as well as providing a non-corrosive surface.

Figure 3:
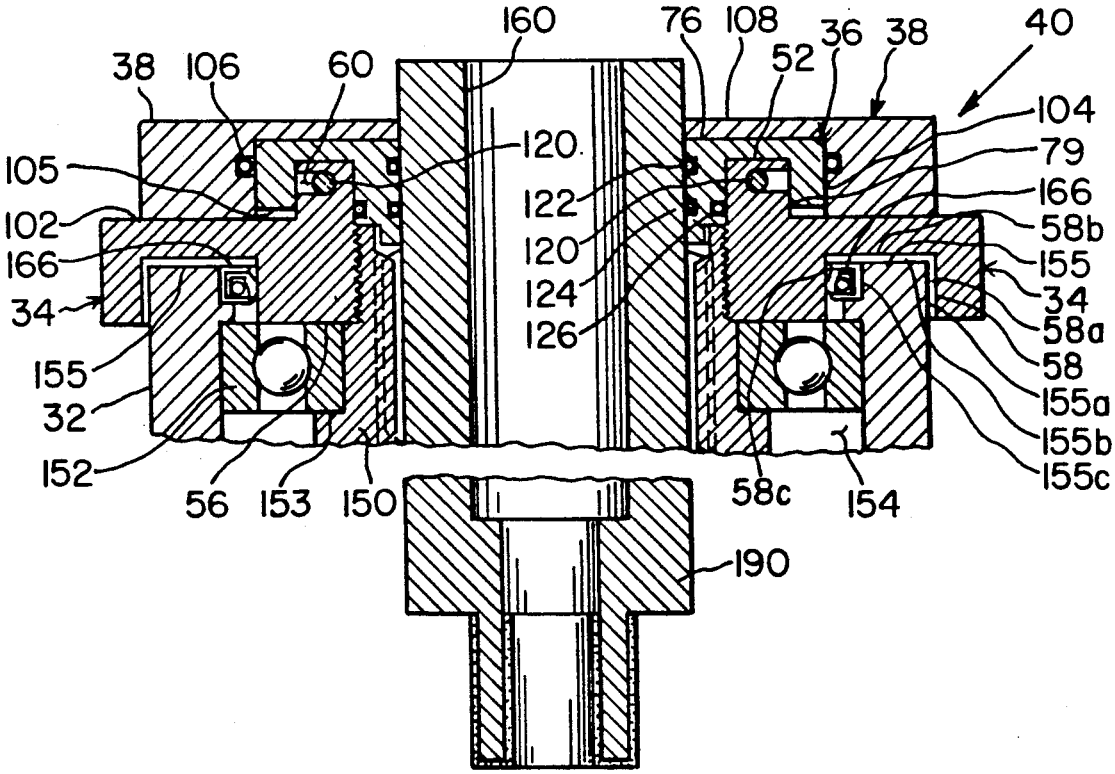
FIG. 3 is a vertical section of a portion of the rotary drill head showing the flinger assembly in accordance with the present invention.
Figure 4:
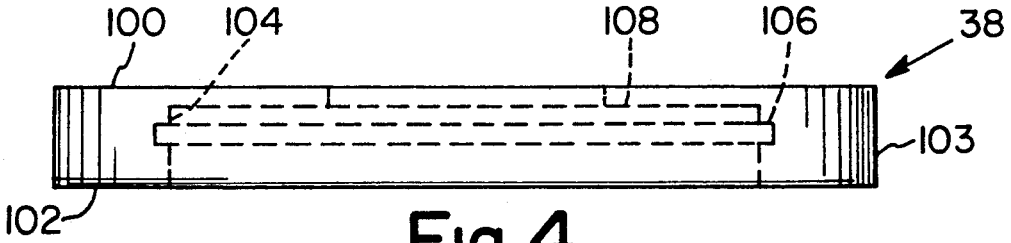
FIG. 4 is a side view of a top plate in accordance with the present invention.
Figure 5:
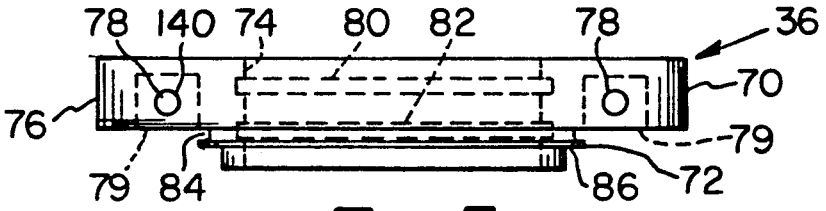
FIG. 5 is a side view of a top cap in accordance with the present invention.
Figure 6:
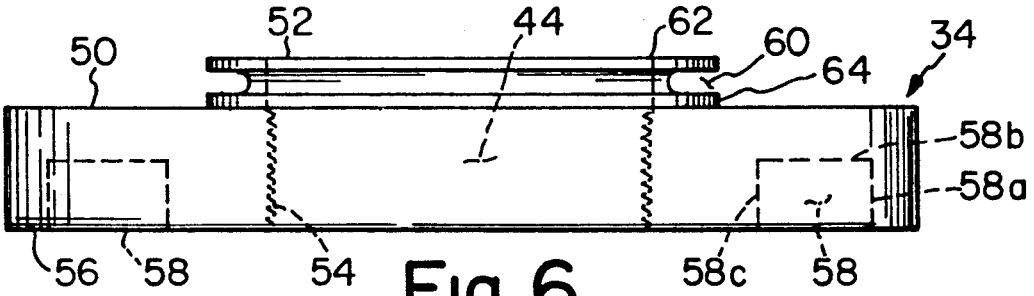
FIG. 6 is a side view of a flinger in accordance with the present invention.

As shown in FIG. 3 of the drawings, flinger assembly 40 is threaded to the upper threaded portion of a support member 150 through the threaded inner surface of flinger 34. A portion of flinger bottom surface 56 rests on a bearing assembly 152 that is sandwiched between flinger 34 and a ledge 151 on support member 150. Drill head cover 32 includes a cavity 154 in which a lubricant, such as grease, is supplied. An upper portion 155 of drill head cover 32 is received within flinger annular recess 58. As shown in FIG. 3 of the drawings, upper portion 155 is a ring shaped projection defined by surfaces **155*a*, 155*b*, and 155*c*. Spaced surfaces 155*a* and 155*c* are concentric and cylindrical and surface 155*b*, which connects surfaces 155*a* and 155*c*, is in the shape of a flat annulus. Further, surface 155*c* defines the inner surface of the drill head cover upper portion 155, surface 155***b* defines the end of drill head cover upper portion 155 and 155*a* defines the outer surface of upper portion 155.

A rotatable tubular member 190 having a drill retaining socket 160 extends above the upper end of support member 150 and passes through coaxial passage 112 in flinger assembly 40. Socket 160 receives drill steel 26. O-rings 122 and 124 are sandwiched between socket 160 and the surfaces that define O-ring grooves 80 and 82 of top cap 36 forming a fluid tight seal therebetween. Lip seal 166 is sandwiched between flinger wall 58*c* and drill head cover wall 155*c*. Flinger walls 58*a*, 58*b* are positioned adjacent to and in close proximity to drill head cover walls 155*a* and 155*b*, respectively, thereby forming a liquid tight seal between a cavity 154 and the outside environment. Preferably the respective walls 58*a*, 58*b* and 155*a*, 155*b* should be spaced apart on the order of 0.001" or less, respectively.

The attachment of flinger assembly 40 to drill head 24 is set forth below. Flinger 34 is threaded to support member 150. Top cap 36 is slidably received by socket 160 and engages with flinger 34. Respective pins 120 are inserted into respective pin receiving slots 78, thereby attaching top cap 36 to flinger 34. At this time, fluid seals are formed between socket 160 and drill cover 32 by flinger 34 and top cap 36. Top plate 38 then attaches to top cap 36. In operation, flinger assembly 40 rotates with support member 150 and drill socket 160 relative to drill head cover 32.

Flinger assembly 40 can easily be removed for repair and maintenance of drill head assembly 24 by reversing the above procedure. The elimination of the flinger labyrinth seal and top cap screws of the prior art makes the flinger assembly less expensive to manufacture and easier t maintain than the prior art drill heads. Furthermore, the flinger assembly of the invention avoids the problem associated with the cap screws of the prior art.

This is a significant improvement over the prior art where the cap screws tend to corrode or become damaged from the mining environment requiring excessive downtime and in some cases total replacement of the top cap and flinger.

Having described the preferred embodiments of my invention, it is to be understood that it may be otherwise embodied within the scope of the appended claims.

I claim:

1. In a rotary drill head assembly including a drill head cover having an upper portion, a rotatable tubular member having a drill retaining socket therein and having an upper end and an outer surface and a support member having an upper portion, said rotatable tubular member extending above said upper portion of said support member, the improvement comprising:

a flinger connected to said upper portion of said support member and having an axial passage extending therethrough;

a top cap having an axial passage extending therethrough, said flinger axial passage and said top cap axial passage forming a flinger assembly passage through which said rotatable tubular member passes; and at least one retaining pin received by said flinger and said top cap to attach said flinger and said top cap said at least one retaining pin extending substantially perpendicular to the axis of said rotatable tubular member.

2. The rotary drill head assembly of claim 1 wherein said flinger includes first means for receiving said retaining pin to attach said flinger and said top cap.

3. The rotary drill head assembly of claim 2 wherein said first means is a retaining pin-receiving recess formed in said flinger.

4. The rotary drill head assembly of claim 1 wherein said top cap includes second means for receiving said retaining pin to attach said flinger and said top cap.

5. The rotary drill head assembly of claim 4 wherein said second means is a pin-receiving slot passing through said top cap.

6. The rotary drill head assembly of claim 1 wherein said flinger includes a first means for receiving said retaining pin and said top cap includes second means for receiving said retaining pin, said first means and said second means and said retaining pin attaching said flinger and said top cap.

7. The rotary drill head assembly of claim 6 wherein said first means comprises a retaining pin-receiving recess formed in an outer surface of said flinger and said second means is a pin-receiving slot passing through said top cap.

8. The rotary drill head assembly of claim 7 including a top plate with an axial passage therethrough defined by an inner surface, said axial passage in said top plate forming a plate of said flinger assembly passage, and means for removably attaching said top plate to said top cap, said inner surface of said top plate axial passage covering an end of said top cap retaining pin-receiving slot.

9. The rotary drill head assembly of claim 8 including an O-ring between said inner surface of said top plate axial passage and said top cap so that said top plate is frictionally held in place on said top cap.

10. The rotary drill head assembly of claim 1 wherein said improvement further comprises:

first seal means positioned between said top cap and said flinger; and second seal means positioned between said top cap and said rotatable tubular member.

11. The rotary drill head assembly of claim 10 wherein said first and second seal means are O-rings.

12. The rotary drill head assembly of claim 1 including a top plate having an axial passage therethrough and means attaching said top plate to said top cap, said axial passage in said top plate forming a part of said flinger assembly passage.

13. The rotary drill head assembly of claim 12 wherein said top plate includes means to protect said retaining pin from the outside environment and to hold said retaining pin in place.

14. The rotary drill head assembly of claim 12 wherein at least one of said flinger, said top cap and said top plate has a ceramic coating thereon.

15. The rotary drill head assembly of claim 1 wherein said drill head cover upper portion includes a projection formed by an inner surface, an outer surface and an end surface, said inner surface and said outer surface being concentric and cylindrical and said end surface connects said inner surface and said outer surface and is in the shape of a flat annulus; and said flinger includes an annular recess in a bottom surface, said recess defined by a first wall, a second wall and a third wall, said first wall and said second wall being concentric and cylindrical a d said third wall connects said first wall and said second wall and is in the shape of a flat annulus, whereby said outer surface and said end surface are positioned adjacent to and in close proximity to said first wall and said third wall, respectively, thereby forming a liquid tight seal therebetween to seal an internal cavity of the drill head assembly from the outside environment.

16. The rotary drill head assembly of claim 15 including a fluid seal positioned between said inner surface and said second wall.

17. The rotary drill head assembly of claim 15 wherein at least one of said first wall, said second wall, said third wall, said inner surface, said outer surface and said end surface has a ceramic coating.

18. A rotary drill head assembly including a drill head cover having an upper portion, a support member having an upper portion and a rotatable tubular member having a drill retaining socket extending above said upper portion of said support member and having an outer surface, the improvement comprising:

a flinger attached to said upper portion of said support member, said flinger having a bottom surface with an annular recess formed therein, said annular recess defined by first, second and third walls, said first wall and said second wall being concentric and cylindrical and said third wall connecting an end of said first wall and an end of said second wall and having the shape of a flat annulus;

a top cap attached to said flinger, said top cap and said flinger forming a flinger assembly through which said rotatable tubular member extends, a retaining pin extending substantially perpendicular to the axis of said rotatable tubular member and between said flinger and said top cap; and said upper portion of said drill head cover is an annular projection having an inner surface, an outer surface and an end surface, said inner surface and said outer surface being concentric and cylindrical and said end surface connecting an end of said inner surface and an end of said outer surface, said inner surface and said outer surface being concentric and cylindrical and said end surface connecting an end of said inner surface and an end of said outer surface, said end surface having the shape of a flat annulus, whereby said outer surface and said end surface are positioned adjacent to and in close proximity to said first wall and said second wall, respectively, of said recess thereby forming a liquid tight seal to seal an internal cavity of the drill head assembly from the outside environment.

19. A flinger assembly for a rotary drill head assembly including a drill head cover, a rotatable tubular member having a drill retaining socket formed therein and a support member having an upper portion comprising:

a flinger for attachment to said upper portion of said support member and having an axial passage extending therethrough;

a top cap attached to said flinger having an axial passage extending therethrough aligned with said axial passage in said flinger, said flinger axial passage and said top cap axial passage forming a flinger assembly passage for said rotatable tubular member; and a retaining pin extending between said flinger and said top cap to attach said flinger and said top cap said retaining pin extending substantially perpendicular to the axis of said rotatable tubular member.

20. The flinger assembly of claim 19 including a top plate removably attached to said top cap and means to protect said retaining pin from the outside environment and to hold said retaining pin in place, wherein said retaining pin is removably attached to said top cap and to said flinger.

* * * * *

UNITED STATES PATENT AND TRADEMARK OFFICE

CERTIFICATE OF CORRECTION

PATENT NO. : 5,195,598

DATED : March 23, 1993

INVENTOR(S) : Donald L. DeVall

It is certified that error appears in the above-identified patent and that said Letters Patent is hereby corrected as shown below:

Column 4 Line 36 after "respectively" insert --.--.

Column 4 Lines 49-50 "As shown in FIG. 14 of the drawings, "Flinger 34, top" " should read --Flinger 34, top--.

Column 4 Line 59 "151" should read --153--.

Column 5 Line 37 "t" should read --to--.

Claim 1 Line 66 Column 5 before "said at least" insert --,--.

Claim 8 Line 27 Column 6 "plate" should read --part--.

Claim 15 Line 66 Column 6 "a d" should read --and--. (second occurrence)

Claim 19 Line 29 Column 8 before "said retaining pin" insert --,--.

Signed and Sealed this

Thirtieth Day of November, 1993

Bruce Lehman

*Attest:*

BRUCE LEHMAN

*Attesting Officer*

*Commissioner of Patents and Trademarks*